US008646630B2

(12) United States Patent
Franzen et al.

(10) Patent No.: US 8,646,630 B2
(45) Date of Patent: Feb. 11, 2014

(54) BRIDGE CRANE OR GANTRY CRANE COMPRISING A CABLE LENGTH-ADJUSTING ELEMENT FASTENED TO THE LOAD ACCEPTING MEANS

(75) Inventors: Hermann Franzen, Monchengladbach (DE); Armin Wieschemann, Oberhausen (DE); Mike Hegewald, Oberhausen (DE); Jannis Moutsokapas, Monheim (DE)

(73) Assignee: Gottwald Port Technology GmbH, Düsseldorf (DE)

( * ) Notice: Subject to any disclaimer, the term of this patent is extended or adjusted under 35 U.S.C. 154(b) by 146 days.

(21) Appl. No.: 13/133,459

(22) PCT Filed: Nov. 30, 2009

(86) PCT No.: PCT/EP2009/066087

§ 371 (c)(1),
(2), (4) Date: Jun. 8, 2011

(87) PCT Pub. No.: WO2010/066603

PCT Pub. Date: Jun. 17, 2010

(65) Prior Publication Data

US 2011/0240583 A1 Oct. 6, 2011

(30) Foreign Application Priority Data

Dec. 9, 2008 (DE) ..... 10 2008 061 197

(51) Int. Cl.
*B66C 13/10* (2006.01)

(52) U.S. Cl.
USPC ..... 212/318; 212/312

(58) Field of Classification Search
USPC ..... 212/312, 315–324, 326–328, 330–334; 414/340, 342, 399, 460
See application file for complete search history.

(56) References Cited

U.S. PATENT DOCUMENTS 3,042,227 A 7/1962 Tantlinger (Continued)

FOREIGN PATENT DOCUMENTS

DE 2752212 5/1979

(Continued)

OTHER PUBLICATIONS

Claims (in German) as amended under Article 34 in International Application No. PCT/EP2009/066087.
Claims (in English) as amended under Article 34 in International Application No. PCT/EP2009/066087.
International Search Report and Written Opinion of the International Searching Authority from corresponding Patent Cooperation Treaty (PCT) Application No. PCT/EP2009/066087, mailed Mar. 19, 2010.

(Continued)

*Primary Examiner* — Sang Kim
*Assistant Examiner* — Juan Campos, Jr.
(74) *Attorney, Agent, or Firm* — Gardner, Linn, Burkhart & Flory, LLP

(57) ABSTRACT

A bridge crane or gantry crane is provided for transferring standard cargo holders, especially ISO containers and swap bodies, between roads and railways. The crane includes a crane trolley that can be moved along a crane carrier in the direction of travel of the crane trolley, and on which a rigid mast is guided that extends in a raising and lowering direction. The mast can be moved in the raising and lowering direction using at least one lifting gear and cables, the lifting gear being disposed on the crane trolley. A load accepting means for standard cargo holders is rigidly fastened to the lower end of the mast. At least two cables are provided which are in contact with opposite ends of a double arm that is mounted on the load accepting means about a substantially horizontal swivel pin.

23 Claims, 5 Drawing Sheets

(56) References Cited

U.S. PATENT DOCUMENTS

| | | | | |
|---|---|---|---|---|
| 3,247,974 | A | 4/1966 | Dechantsreiter | |
| 3,402,824 | A | 9/1968 | Zweifel | |
| 3,814,211 | A | 6/1974 | Pamer | |
| 5,915,906 | A * | 6/1999 | Lucking et al. | 414/142.8 |
| 6,030,168 | A * | 2/2000 | Kroll et al. | 414/561 |
| 6,698,990 | B1 * | 3/2004 | Dobner et al. | 414/139.9 |
| 7,004,338 | B2 * | 2/2006 | Franzen et al. | 212/319 |
| 2011/0163058 | A1 * | 7/2011 | Franzen et al. | 212/319 |

FOREIGN PATENT DOCUMENTS

| | | |
|---|---|---|
| DE | 2911938 | 10/1980 |
| DE | 20013245 | 1/2002 |
| EP | 0796813 | 8/1998 |
| EP | 1365984 | 3/2005 |
| JP | 49-14575 | 4/1974 |
| JP | 50-11137 | 4/1975 |
| JP | 61-248827 | 11/1986 |

OTHER PUBLICATIONS

International Preliminary Examination Report (IPER) of the International Searching Authority from corresponding PCT Application No. PCT Application No. PCT/EP2009/066087, mailed Dec. 29, 2010.

English translation of the International Search Report of the International Searching Authority from corresponding Patent Cooperation Treaty (PCT) Application No. PCT/EP2009/066087, mailed Mar. 19, 2010.

English translation of the International Preliminary Examination Report (IPER) of the International Searching Authority from corresponding PCT Application No. PCT Application No. PCT/EP2009/066087.

Substitute Specification, drawings, and Preliminary Amendment from co-pending U.S. Appl. No. 13/132,118, filed Jun. 1, 2011.

Substitute Specification, drawings, and Preliminary Amendment from co-pending U.S. Appl. No. 13/133,532, filed Jun. 8, 2011.

Substitute Specification, drawings, and Preliminary Amendment from co-pending U.S. Appl. No. 13/133,616, filed Jun. 8, 2011.

* cited by examiner

BRIDGE CRANE OR GANTRY CRANE COMPRISING A CABLE LENGTH-ADJUSTING ELEMENT FASTENED TO THE LOAD ACCEPTING MEANS

FIELD OF THE INVENTION

The invention relates to a bridge crane or gantry crane for the handling of standardized cargo holders, especially for the handling of ISO containers and swap bodies between roads and railways.

BACKGROUND OF THE INVENTION

A cargo handling device for goods containers, especially containers in railway traffic, is disclosed in German application laid open DE 27 52 212 A1. In one embodiment depicted there, the cargo handling device includes a gantry crane with a crane trolley, from which a telescoping mast is hung. The mast has three telescopic segments. The upper end of the uppermost telescopic segment is rigidly fastened to the crane trolley, while at the lower end of the lowermost telescopic segment is rigidly hung a C-shaped frame. This C-shaped frame, with upper horizontal arms and lower horizontal arms, is provided so as to be able to move the load suspension means hanging from the lower horizontal arm sideways underneath an overhead line of a railroad section. In order to move the C-shaped frame and the load suspension means in the raising and lowering direction, cables with drums are arranged on the crane trolley, from which a total of four cables run to cable rollers disposed on the top of the horizontal arms.

A bridge crane for the stacking of containers, especially ISO containers, is disclosed in European patent EP 1 365 984 B1, which moves containers into and/or out from a storage area inside a container terminal. The bridge crane has a crane girder, which spans the width of an essentially cubical storage area. On the crane girder, a crane trolley can travel along its lengthwise direction in the width direction of the storage area. The crane girder can travel on running gears in the direction of travel of the crane and thus transversely to the crane trolley on the crane girder, and also in the lengthwise direction of the storage area. In order to handle the containers, a mast is disposed on the crane trolley, being guided and able to be raised or lowered in the vertical direction. The mast is fashioned as a box girder, and lifting gears are arranged on the crane trolley for the raising and lowering movement of the mast. At the lower end of the mast, pointing in the direction of the containers being handled, a load suspension means for containers, especially a so-called spreader, is hung by a pivot. The load suspension means is connected by cables to the lifting gears on the crane trolley. The mast is not driven directly in the raising and lowering direction, but only indirectly by the cables engaging with the load suspension means. The use of a rigid mast between the crab and the load suspension means brings the advantage that the container can be handled with little swaying motion, unlike the load suspension means that are also used and hung solely from cables.

Furthermore, a gantry crane for the handling of containers and swap bodies between railway and road is disclosed in European patent EP 0 796 813 B1. In keeping with the usual design of a gantry crane, a crane trolley is provided that can travel on a crane girder in its lengthwise direction, on which are fastened two hydraulic piston-cylinder units, one behind the other when looking in the direction of travel of the gantry crane, and at a spacing from each other. The piston-cylinder units are each vertically oriented and include a lift cylinder and a piston rod moved therein. The lift cylinders are rigidly fastened to the crane trolley and the piston rods starting from the crane trolley can extend downward in the lowering direction and be retracted in corresponding manner in the lifting direction. A hanger frame is fastened to the ends of the piston rods that are opposite the crane trolley by means of oblong hole connections, and a load suspension means in the form of a spreader frame is hung from this. The connection of the hanger frame by oblong hole connections to the piston rods was chosen to equalize differences in the synchronized movement of the piston-cylinder units and any slanted position of the container. Furthermore, the hanger arm and the load suspension means disposed therein are offset to the side by at least 500 mm in relation to the lengthwise axis of the two piston-cylinder units so that containers or swap bodies can also be set down by the gantry crane on a railroad car or picked up from it and at the same time an overhead guide wire can run underneath due to the sideways offset arrangement of the load suspension means on the piston rod.

Moreover, another crane layout for handling of containers in railway traffic disclosed in German patent laid open DE 29 11 938 B2. This crane layout is also designed as a gantry crane, having a crane trolley with a mast guided on it and able to travel in the lifting and lowering direction. At the lower end of this mast is firmly disposed a jib that projects sideways in relation to the lengthwise direction of the mast, on which a load suspension means for the container is hung by means of a rotary connection with a vertical axis of rotation. The mast can be raised and lowered by a cable mechanism, whose cable is attached to the mast in the region of the lower third of the mast. In addition to the rotary connection on the load suspension means, the crane trolley has a rotation device with a circular running track, on which a rotary frame can travel by running wheels about a vertical axis. The mast is hung eccentrically from the rotary frame, and so it can likewise rotate along with the cable mechanism. Thanks to these double rotation capabilities in the area of the load suspension means and the crane trolley, when swinging the container in and out underneath a guide wire of an overhead line, the container should not lose its parallel orientation to a railroad car being loaded or unloaded.

Furthermore, the German utility model DE 200 13 245 U1 discloses a mechanism for the handling of containers, which is configured as a half-gantry crane. Here as well there is a mast suspended from a crane trolley and able to travel vertically in the raising and lowering direction. At the lower end of the mast, a connection arm is disposed, projecting horizontally and to the side, on which a load suspension means for containers or cargo units is hung, in order to be able to set down and pick up containers sideways on a railroad car underneath a guide wire of an overhead line. Here as well, the mast is joined to the crane trolley by a rotary device.

SUMMARY OF THE INVENTION

The present invention provides an improved bridge crane or gantry crane with a rigid outrigger for the handling of standard cargo holders, especially ISO containers and swap bodies, such as between a railway and a road.

According to one form of the invention, a bridge crane or gantry crane for the handling of standard cargo holders, especially for the handling of ISO containers and swap bodies between roads and railways, includes a crab or crane trolley which can be moved along a crane girder in the direction of travel of the crane trolley, on which a rigid mast is guided that extends in a raising and lowering direction, which can be moved in the raising and lowering direction using at least one lifting gear and cables. The lifting gear is disposed on the crane trolley, and a load suspension device for standard cargo holders is rigidly fastened to the lower end of the mast. The cables from the at least one lifting gear engage with the load suspension device, and the at least two cables engage at opposite ends of a double arm, which is fastened to the load suspension device about an essentially horizontal pivot axis. This accomplishes a direct flow of force between cables and load suspension device with an equalizing of cable length, and the mast may serve solely for guiding purposes. Optionally, the rigid mast is a single-piece mast and not a telescoping one.

In order to prevent cables from transferring twist to the mast through the rigid attachment of the load suspension device to the mast, for example, on account of unsynchronized movement, at least one cable may engage with the load suspension device via a cable length-adjusting element.

Optionally, the load suspension device includes a hanger frame and a spreader frame hung from it, the hanger frame being rigidly secured to the lower end of the mast, and the cables engaging with the hanger frame.

In one embodiment, the spreader frame and the hanger frame each have a rectangular cross section, they extend by their lengthwise dimension in the direction of travel of the crane, and the lower ends of a total of four cables are fastened in the region of the corners of the hanger frame. This facilitates length adjustment of the cables, while at the same time firmly attaching the cables to the hanger frame. In this embodiment, the front two cables and the rear two cables in the direction of travel of the crane are secured to the opposite ends of a double arm, which is mounted on the hanger frame able to pivot at its middle about a pivot axis running in the direction of travel of the crane.

In order to facilitate the handling of standard cargo holders, especially for the handling of ISO containers and swap bodies, such as between road and railway and underneath a guide wire of an electrified railroad section, the load suspension device may be disposed with a sideways or lateral offset from the mast. With the load suspension device hung rigidly from the mast, an especially stable guidance of the load suspension device may be achieved, even though the load suspension device may extend or project out to the side relative to the mast.

In another aspect, the load suspension device is disposed with a sideways offset from the mast in the range of about 500 mm to 1500 mm.

An especially stable supporting of the mast in the region of the crane trolley may be achieved when the crane girder includes a first girder and a second girder, on which crane trolley rails are disposed, on which the crane trolley can travel in the direction of travel of the crane trolley, and the first girder and the second girder are spaced apart from each other in the direction of travel of the crane, running perpendicular to the direction of travel of the crane trolley.

In yet another aspect, the possible uses of the bridge crane and gantry crane may be expanded when the mast is enabled to turn about a vertical pivot axis relative to the crane trolley.

These and other objects, advantages and features of this invention will become apparent upon review of the following specification in conjunction with the drawings.

DETAILED DESCRIPTION OF THE PREFERRED EMBODIMENT

Figure 1:
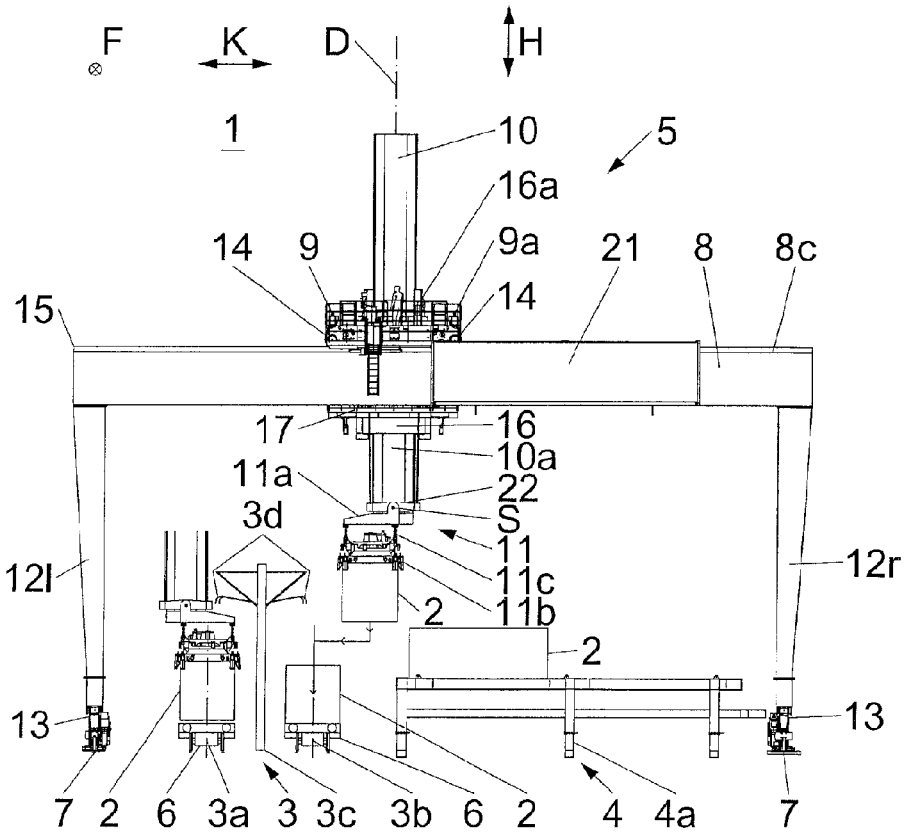
FIG. 1 is a front elevation of a handling facility with a gantry crane in accordance with the present invention.

FIG. 1 shows a view of a handling facility 1 for standard cargo holders 2, such as ISO containers and swap bodies, between a road and a railway. The handling facility 1 includes a railway handling zone 3, a road handling zone 4, and a bridge or gantry crane 5 which, in the illustrated embodiment is, configured as a gantry crane.

The railway handling zone 3 includes a first track section 3*a* and, running parallel with this at a spacing, a second track section 3*b*. Between the first and second track sections 3*a* and 3*b*, each running straight in the railway handling zone, are a plurality of railway poles 3*c* disposed in usual fashion, each carrying a guide wire 3*d* above the first and second track sections 3*a*, 3*b*. Railroad cars 6 can move along the first and second track sections 3*a* and 3*b* for loading and unloading of the standard cargo holders 2.

The road handling zone 4 is disposed to border the second track section 3*b* at the side. In the illustrated embodiment, this road handling zone 4 includes support racks 4*a* on which standard cargo holders 2 that are unloaded from the railroad cars 6 can be set down for interim storage. Then the standard cargo holders 2 can be loaded further onto trucks (not shown) from the cargo holders 2.

The railway handling zone 3 and the road handling zone 4 are each situated in the range of the bridge or gantry crane 5, which spans these two handling zones 3 and 4.

This bridge or gantry crane 5 includes a crane girder 8 which can travel on rails 7 in the direction of travel F of the crane 5 (FIG. 2) along the first and second track sections 3*a*, 3*b*. A crane crab or trolley 9 can travel on the crane girder 8, transversely to the direction of travel F of the crane girder 8, in the direction of travel K of the crane trolley 9. From the crane trolley 9 is hung a mast 10, which can be raised and lowered vertically and relatively to the crane trolley 9, in order to pick up and set down standard cargo holders 2 by means of a load suspension device 11 secured to its lower end 10*a*. The load suspension device 11 is divided into a hanger frame 11*a*, which is firmly secured to the lower end 10*a* of the mast 10, and a spreader frame 11*b*, which is hung by chains 11*c* from the hanger frame 11*a*. The hanger frame 11*a* projects sideways in relation to the mast 10. The rigid mast 10 here is preferably a single piece and not telescopic. This rigid mast 10 thus affords an especially stable guidance of the load suspension device.

The crane girder 8 is supported at its opposite ends by right and left vertical supports 12*l* and 12*r*, looking as viewed in the direction of travel K of the crane 5. As a whole, the bridge or gantry crane 5 is generally U-shaped and open at the bottom (i.e., an inverted 'U'), when viewed in the direction of travel F of the crane 5. The vertical supports 12*l* and 12*r* receive the crane girder 8 at their upper ends, at its opposite end regions, and at their lower ends they can travel by crane running gears 13 on the rails 7 in the direction of travel F of the crane 5.

The crane trolley 9 includes a rectangular base frame 9*a*, at the four corners of which are disposed crane trolley running gears 14, which travel on crane trolley rails 15 disposed on the crane girder 12. In the base frame 9*a* of the crane trolley 9, in the middle area, there is an opening through which a rotary pipe 16 is led. The rotary pipe 16 is supported at its upper end 16*a* on the base frame 9*a* of the crane trolley 9 by a rotary connection 16*b*, and can turn about a vertical pivot axis D by the rotary connection 16*a*. The mast 10 runs inside the rotary pipe 16 and is guided there.

Figure 2:
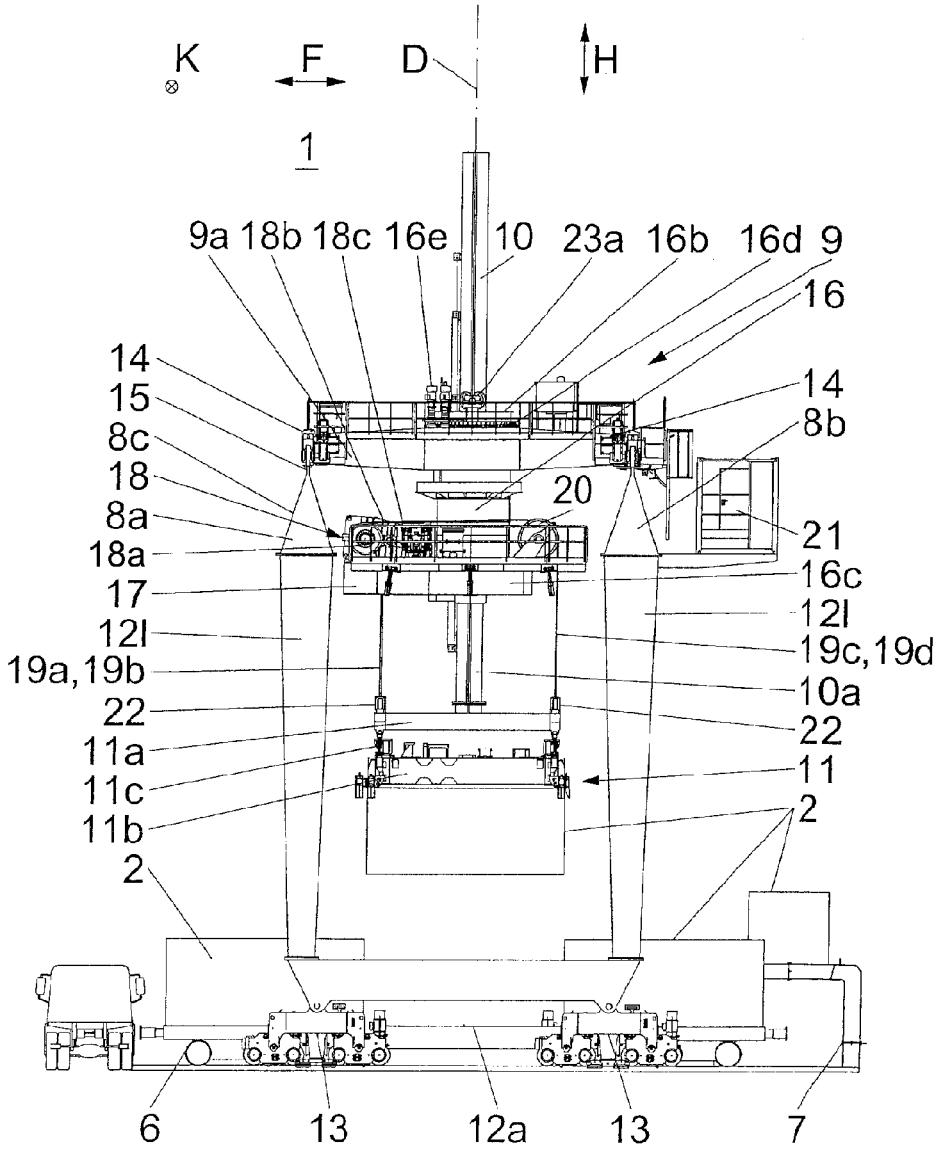
FIG. 2 is a side elevation of the handling facility of FIG. 1.

As can be seen in FIG. 2, the crane girder 8 is fashioned as a double girder with a first girder 8*a* and a second girder 8*b*, which are arranged on the same height level and at a distance behind each other, when viewed in the direction of crane travel F. Accordingly, the left vertical support 121 and the right vertical support 12*r* are also fashioned as double supports looking in the direction of travel F of the crane 5, being joined to each other in the region of their lower end by a base girder 12*a* in U-shaped manner.

FIG. 2 also shows that the first girder 8*a* and the second girder 8*b* each have a triangular cross section. This triangular cross section has the form of an equilateral triangle, the angle in the region of the vertex 8*c* being around 30 degrees. The crane trolley rail 15 on which the crane trolley 9 can travel in the direction of travel K of the crane trolley 9 is secured each time in the region of the vertices 8*c* of the first girder 8*a* and the second girder 8*b*.

To drive the rotary pipe 16, a toothed collar 16*d* is provided around its outside, which engages with an electric motorized rotary drive 16*e*, which is supported on the base frame 9*a*, as best shown in FIG. 2. In order to move the mast 10 in the raising and lowering direction H, a rectangular lifting frame 17 is rigidly fastened to a lower end 16*c* of the rotary pipe 11. A lifting gear 18 for the mast 10 is arranged on the lifting frame 17 of the crane trolley 9. The lifting gear 18 has a first cable drum 18*a* and a second cable drum, mounted coaxially to each other on a shared gearing 18*b*, which is actuated by a drive motor 18*c*. A first cable 19*a* and a second cable 19*b* run off from the first cable drum 18*a*. A third cable 19*c* and a fourth cable 19*d* run off from the second cable drum. Accordingly, there are four cables present 19*a*, 19*b*, 19*c*, 19*d*, which either run off directly from the first cable drum 18*a* or second cable drum vertically downward or are led horizontally to the opposite side of the mast 10, where they are deflected 90 degrees vertically downward by a deflection roller 20 with a horizontal axis of rotation. The ends of the cables 19*a*, 19*b*, 19*c*, 19*d* are connected to the hanger frame 11*a*.

A container-type holder 21 is fastened on the outside of the second girder 8*b*, in which the controls and the electrical or electronic power pack for the bridge or gantry crane 5 is arranged (FIG. 2).

Figure 3:
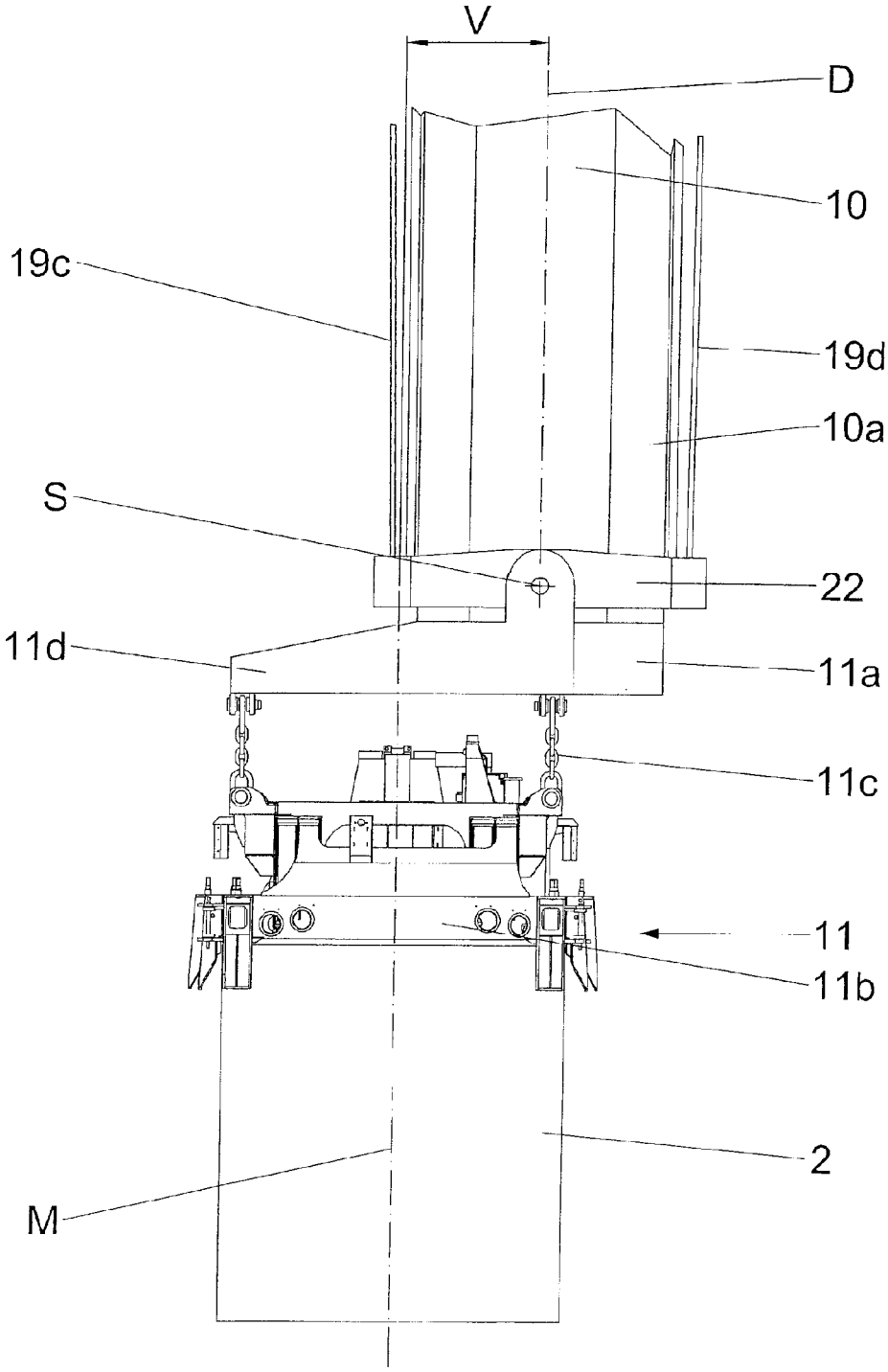
FIG. 3 is an enlarged portion of the front elevation of FIG. 1, taken from the region of a load suspension device.
Figure 5:
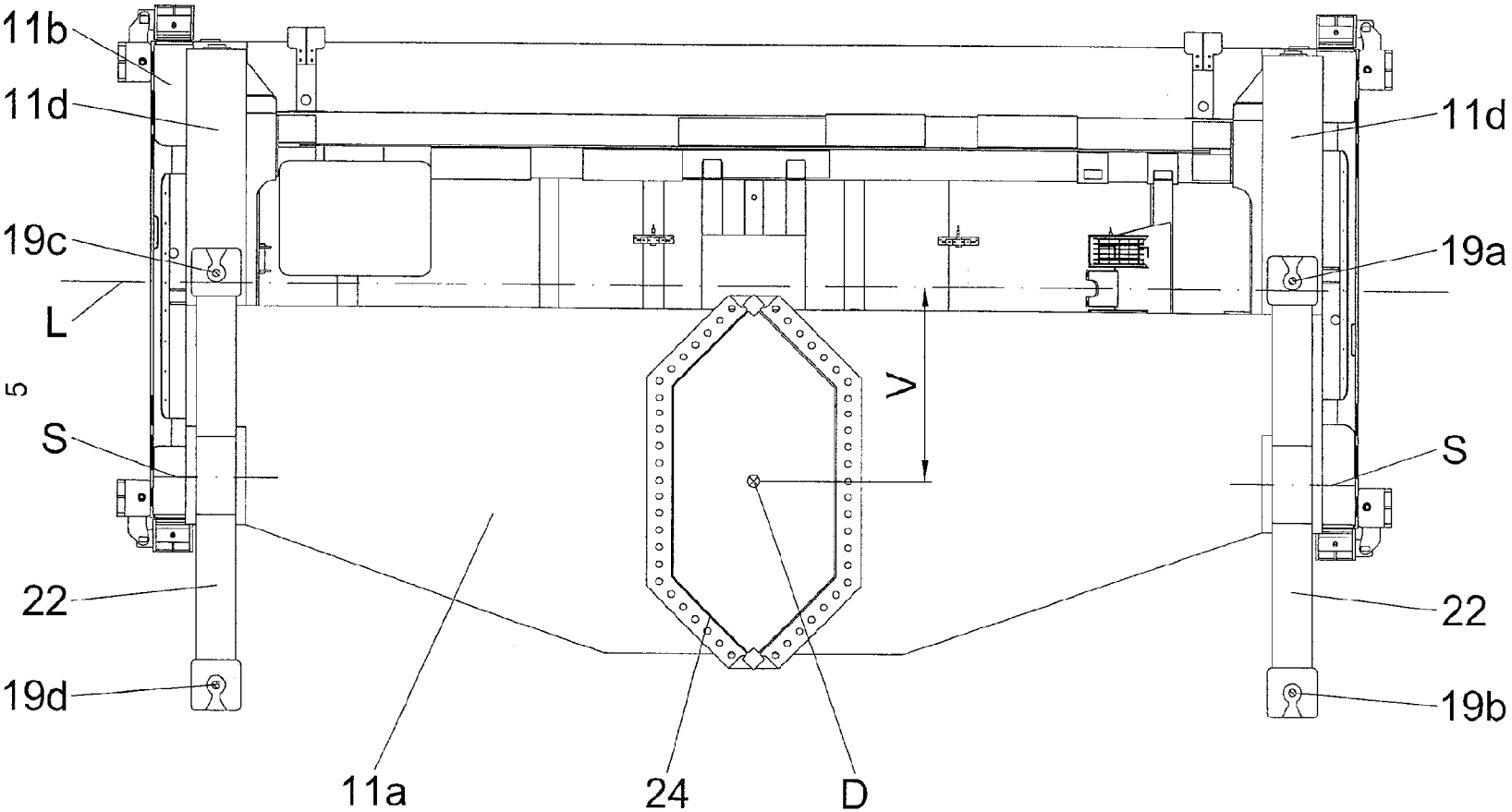
FIG. 5 is a top plan view of the load suspension device of FIG. 3, in which the mast has been omitted for clarity.

The hanger frame 11*a* has an essentially rectangular cross section when viewed from above (FIG. 5). The four cables 19*a*, 19*b*, 19*c*, 19*d* are attached to the respective corners of the hanger frame 11*a* (FIG. 3). The spreader frame 11*b* is typically hung by chains 11*c* from the hanger frame 11*a*.

It is also evident with reference to FIG. 3 that the hanger frame 11*a*, which is firmly joined to the lower end 10*a* of the mast 10, is fashioned in the style of a jib and juts out sideways in relation to the axis of rotation D of the mast 10, and thus also projects sideways beyond the contour of the mast 10. In relation to the center line M running through the middle of the points of suspension of the chains 11*c* for the spreader frame 11*b*—when viewed in the lengthwise direction of the standard cargo holder 2—the hanger frame 11*a* is displaced sideways by the offset V from the axis of rotation D, running in the lengthwise direction of the mast 10. The side offset V may be in the range of 800 mm to 1500 mm, for example. In the illustrated embodiment, it is around 1000 mm, since the guide wire 3*d* has been attached with a displacement in the range of the permitted tolerance inward toward the railway pole 3*c*. But the guide wire 3*d* still remains here easily reachable by the current collectors of a train.

The articulation of the first cable 19*a* and the second cable 19*b* to the hanger frame 11*a* is also evident with reference to FIG. 3. This connection can pivot about a horizontally running pivot axis S by means of a double arm 22. The arrangement of the first and second cables 19*a*, 19*b* across the double arm 22 on the hanger frame 11*a* has the benefit that differences in synchronized running of the cables 19*a*, 19*b*, 19*c*, 19*d*, as they are wound up and paid out, can be equalized in this way and do not lead to twisting in the hanger frame 11*a* or the lifting frame 17. A second double arm 22 is provided for the third and fourth cables 19*c* and 19*d* at the opposite end of the hanger frame 11*a*. The pivot axes S of the first double arm and the second double arm 22 are coaxially oriented.

Figure 4:
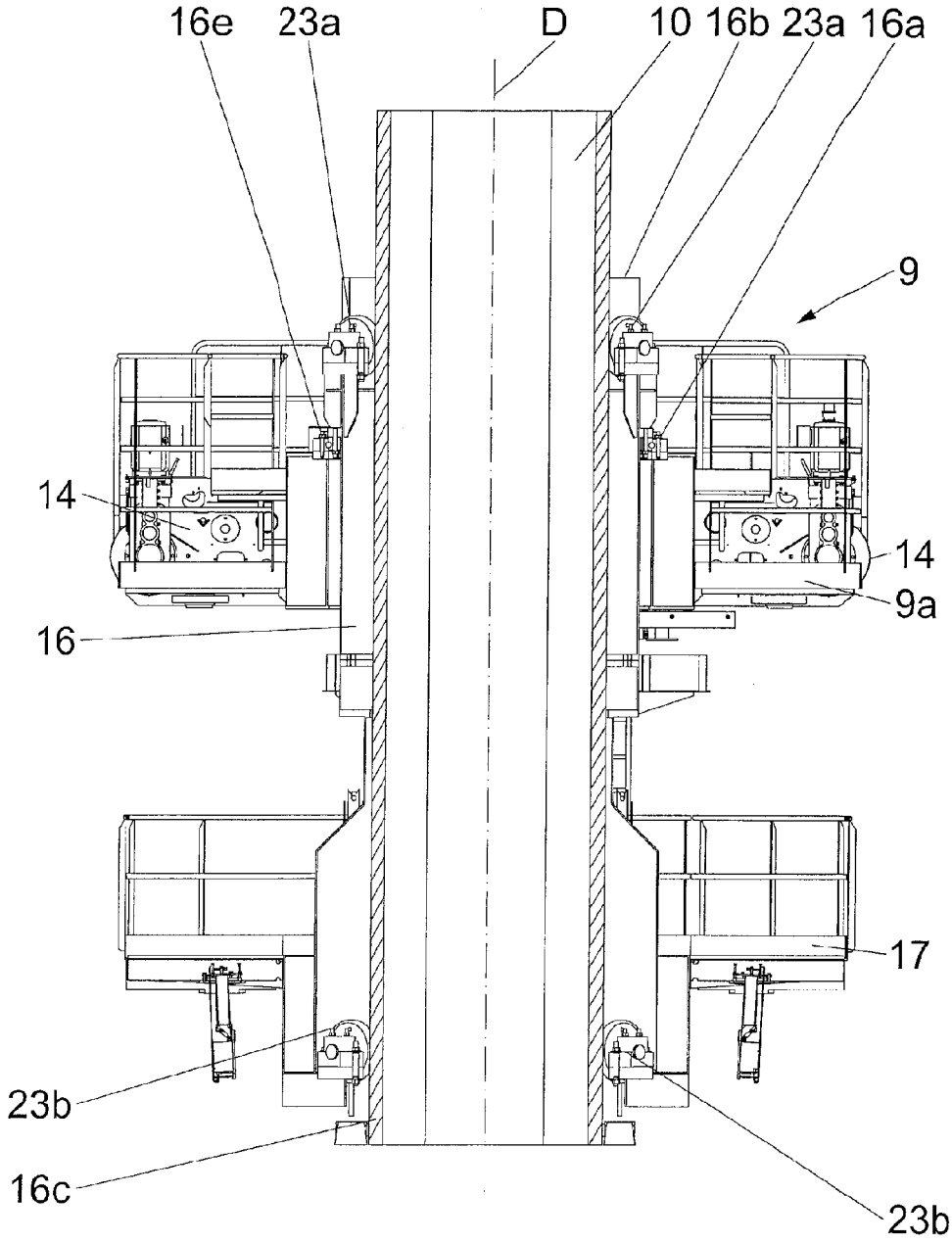
FIG. 4 is an enlarged portion, shown partly in section, and taken from FIG. 1 in the region of a rotary connection.

Referring to FIG. 4, the mast 10 is guided by lower guide elements 23*a* in the region of the lower end 16*c* of the rotary pipe 16 and by upper guide elements 23*b* in the region of the upper end 16*b* of the rotary pipe 16. The lower and upper guide elements 23*a* and 23*b* are configured as guide rollers, which guide the mast 10 on four sides and opposite each other.

Referring to FIG. 5, in which the mast is omitted for clarity, a connection element is shown in the form of a flange with screw holes on the hanger frame 11*a* in the middle. Accordingly, the lower end 10*a* of the mast 10 is also provided with an encircling flange so that the hanger frame 11*a* can be screwed rigidly to the lower end 10*a* of the mast 10. Due to the shape of the connection element 24, one can see that the mast 10 has a slightly oblong hexagonal cross section.

In order to absorb the forces arising from the sideways unloaded suspension of the spreader frame 11*b* on the hanger frame 11*a*, the hanger frame next to the lower end 10*a* of the mast 10 is formed as a massive platelike or reinforced boxlike structure, being essentially rectangular when seen in top view while, starting from the connection element 24, the width of the hanger frame 11*a* decreases in linear manner outward, in accordance with the strain. In the region of the ends of the hanger frame 11*a*, two rectangular and boxlike hanger arms 11*d* are arranged so that the hanger frame 11 in top view has a somewhat U-shaped or forklike appearance. The hanger arms 11*d* extend at right angles from the hanger frame 11*a* and at their ends and underside are situated the attachment points for the chains 11*c* to hang the spreader frame 11*b*.

It will be appreciated that, due to the special configuration of the hanger frame 11*a* with its sideways protruding hanger arms 11*d*, it is possible to hang the spreader frame 11*b* with the chains 11*c* displaced sideways by an offset V between the central lengthwise direction L of the spreader frame 11*c* and the pivot axis D (FIG. 5).

The two double arms 22 are fastened to the hanger frame 11*a* so that they can tilt upward about a pivot axis S at their middle (FIG. 5). The extensions of the pivot axes S intersect the pivot axis D of the mast. At the respective opposite ends of the double arms 22 are attached the first cable 19*a*, the second cable 19*b*, the third cable 19*c* and the fourth cable 19*d*. Thus, the lift forces of the lifting gear 18 are guided centrally into the hanger frame 11*a* in relation to the pivot axis D. Moreover, it is evident that the double arms 22 run basically parallel to the hanger arms 11*d* and thus the lift forces of the lifting gear 18 act directly in the region of the chains 11*c* that carry the spreader frame 11*b*. Thus, the lift forces are guided almost directly by the hanger arms 11*d* into the first to fourth cables 19*a* to 19*d*, with the exception of the sideways protrusion. Seen in relation to the lengthwise direction L of the spreader frame 11*b*, the double arms 22 and the hanger arms 11*d* are basically at the same height.

Although the above description pertains to a bridge or gantry crane 5, it will be appreciated that it is also possible to configure the bridge or gantry crane as a bridge crane with elevated or spandrel-braced rails or as a half-gantry crane, for example.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A bridge crane or gantry crane for the handling of standard cargo holders between roads and railways, said crane comprising:

a crane girder;

a crane trolley that is movable along the crane girder in a direction of travel of the crane trolley;

a rigid mast guided on the crane trolley, the mast extending in a raising and a lowering direction, wherein the mast is a single piece and non-telescopic;

at least one lifting gear having at least two cables associated therewith, the lifting gear being disposed on the crane trolley, for moving the mast in the raising direction and the lowering direction;

a load suspension device configured for standard cargo holders, the load suspension device being rigidly fastened to a lower end of the mast;

a cable length-adjusting element including a double arm with opposite ends, wherein the double arm is fastened to the load suspension device about a generally horizontal pivot axis; and wherein the cables associated with the at least one lifting gear engage with opposite ends of the double arm, whereby lengths of the cables are adjustable by tilting the double arm around the generally horizontal pivot axis.

2. The crane according to claim 1, wherein the load suspension comprises a hanger frame and a spreader frame hung from the hanger frame, the hanger frame being rigidly secured to the lower end of the mast and the cables engaging the hanger frame via the double arm.

3. The crane according to claim 2, wherein the spreader frame and the hanger frame each have a rectangular cross section defining corners, and each extends in its respective lengthwise dimension in the direction of travel of the crane trolley, and wherein the cables comprise at least four cables having lower ends that are fastened in the region of the corners of the hanger frame.

4. The crane according to claim 3, wherein the at least four cables include two front cables and two rear cables that are secured to the opposite ends of the double arm of the cable length-adjusting element, which is mounted on the hanger frame and configured to pivot at its middle about the pivot axis, which is oriented generally in the direction of travel of the crane trolley.

5. The crane according to claim 1, wherein the load suspension device is positioned as to be spaced laterally from the mast.

6. The crane according to claim 5, wherein the load suspension device is spaced laterally from the mast in the range of about 500 mm to 1500 mm.

7. The crane according to claim 1, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

8. The crane according to claim 1, wherein the mast is configured to turn about a vertical pivot axis relative to the crane trolley.

9. The crane according to claim 2, wherein the load suspension device is positioned as to be spaced laterally from the mast.

10. The crane according to claim 3, wherein the load suspension device is positioned as to be spaced laterally from the mast.

11. The crane according to claim 4, wherein the load suspension device is positioned as to be spaced laterally from the mast.

12. The crane according to claim 2, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

13. The crane according to claim 3, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

14. The crane according to claim 4, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

15. The crane according to claim 5, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

16. The crane according to claim 2, wherein the mast is configured to turn about a vertical pivot axis relative to the crane trolley.

17. The crane according to claim 3, wherein the mast is configured to turn about a vertical pivot axis relative to the crane trolley.

18. The crane according to claim 4, wherein the mast is configured to turn about a vertical pivot axis relative to the crane trolley.

19. The crane according to claim 5, wherein the mast is configured to turn about a vertical pivot axis relative to the crane trolley.

20. The crane according to claim 7, wherein the mast is configured to turn about a vertical pivot axis relative to the crane trolley.

21. The crane according to claim 11, wherein the crane girder comprises a first girder, a second girder, and crane trolley rails disposed on the first and second girder, wherein the crane trolley can move in the direction of travel, and the first girder and the second girder are spaced apart from each other in the direction of travel of the crane trolley, and are arranged perpendicular to the direction of travel of the crane trolley.

22. The crane according to claim 21, wherein the mast is configured to turn about a vertical pivot axis relative to the crane trolley.

23. The crane according to claim 22, wherein the load suspension device is spaced laterally from the mast in the range of about 500 mm to 1500 mm.

* * * * *

UNITED STATES PATENT AND TRADEMARK OFFICE

CERTIFICATE OF CORRECTION

PATENT NO. : 8,646,630 B2
APPLICATION NO. : 13/133459
DATED : February 11, 2014
INVENTOR(S) : Hermann Franzen et al.

It is certified that error appears in the above-identified patent and that said Letters Patent is hereby corrected as shown below:

In the Specification

Column 5
Line 8, "121" should be --12l--

Signed and Sealed this
Seventeenth Day of March, 2015

Michelle K. Lee

Michelle K. Lee
*Director of the United States Patent and Trademark Office*